United States Patent [19]

Holtz

[11] Patent Number: 4,660,341

[45] **Date of Patent: * Apr. 28, 1987**

[54] COMPOSITE STRUCTURE

[76] Inventor: Neal Holtz, 1739 Church St., NW., Washington, D.C. 20036

[ * ] Notice: The portion of the term of this patent subsequent to Oct. 29, 2002 has been disclaimed.

[21] Appl. No.: 829,891

[22] Filed: Feb. 18, 1986

[51] Int. Cl.[4] ..... E04C 3/10

[52] U.S. Cl. ..... 52/326; 52/337; 52/340; 52/692

[58] Field of Search ..... 52/334, 338, 326, 335, 52/337, 340, 692, 694

[56] References Cited

U.S. PATENT DOCUMENTS

| | | | |
|---|---|---|---|
| 2,864,471 | 12/1958 | Williams | 52/692 |
| 3,527,007 | 9/1970 | McManus | 52/692 X |
| 3,979,868 | 9/1976 | Butts et al. | 52/692 X |
| 4,454,695 | 6/1984 | Person | 52/334 |
| 4,549,381 | 10/1985 | Holtz | 52/337 |

*Primary Examiner*—Carl D. Friedman

*Attorney, Agent, or Firm*—Pollock, Vande Sande & Priddy

[57] ABSTRACT

An open web joist system and a composite concrete structure incorporating said open web joist system wherein the top chord comprises two spaced-apart angle bars held in spaced-apart relationship by bar stock of an open web member and a closure member for blocking the downward flow of concrete between the vertical legs of the top chord. Concrete is thus enabled to flow into the groove formed by the two angle bars at the top chord and serve as a keyway to prevent longitudinal movement of the concrete with respect to the joist members. Bolts are used to suspend spanner bars for holding concrete forms in place, and these bolts pass downwardly through an opening in the closure member to the spanner bars.

4 Claims, 4 Drawing Figures

COMPOSITE STRUCTURE

This invention relates to composite concrete-steel joist structures formed by pouring a concrete slab on forms which are supported by open web joists.

BACKGROUND OF THE INVENTION

In some methods of constructing floors or roofs, steel joists which are supported at their ends by walls or columns are used to span an open area and support forms for concrete. Workers in the construction industry are in search of new construction methods which will reduce the construction costs by any one or more of the following techniques: (1) reducing the amount of materials used; (2) reusing materials such as forming materials; (3) reducing the labor involved in assembling and disassembling structures and forms; (4) using standard, readily available parts; and (5) providing an integrated structure wherein the concrete slab and associated joists are bonded together so that they function as a unit in resisting forces.

The prior art describes various methods, as by reusing forms, by which savings are effected in labor and materials. See, for example, U.S. Pat. No. 4,549,381 issued Oct. 29, 1985 in the name of Neal Holtz for "Composite Joist System". The prior art also describes systems in which joist members and a concrete slab supported thereby act as an integral structural unit. See, for example, U.S. Pat. No. 4,454,695 issued June 19, 1984 for "Composite Floor System".

Although the prior art has developed some economies which can be made in the construction industry, improved structures and improved methods of making the structures are desirable.

SUMMARY OF THE INVENTION

It is accordingly an object of this invention to provide a composite concrete-steel joist system which is economical and fast to erect.

It is another object to provide a simple composite system in which steel joists and a concrete slab which is poured over the joists act as a structural unit.

It is still another object to provide a simple structure which combines elements for suspending concrete forms from joists and elements for producing an integrated concrete-steel joist member.

In accordance with the present invention, there is provided an open web joist system for a composite steel joist-concrete slab comprising:

a top chord;

a bottom chord;

a zig-zag web member comprising metal bar stock secured to said top and bottom chords and triangulating the space therebetween, said top chord comprising first and second metal angle bars, each of said angle bars having a substantially planar horizontal leg, and a substantially planar vertical leg depending downwardly from the inner edge of said horizontal leg, said vertical legs of said first and second metal angle bars being held in spaced-apart relationship by the bar stock of said open web member;

bolt means for supporting at least one spanner bar, said bolt means being suspended from said top chord and having a threaded shank portion extending into the triangular space formed by said open web member; and, a horizontally disposed closure member for blocking the flow of concrete downwardly between and past the vertical legs of said top chord, said closure member extending laterally between the vertical legs of the bars of the top chord at or near the lower edges thereof, and extending longitudinally between two adjacent, upwardly angled sections of the web member.

This system is made of readily available parts such as, for example, standard angle bars, round metal bar stock, conventional nuts and bolts, and metal or plastic strips. The joists and forms may be assembled and disassembled readily with unskilled labor. Furthermore, the combination of concrete slab and joist members acts as an integral unit in resisting forces. The encasement of the top chord of the joist with concrete prohibits relative movement between the top chord and the concrete, either in a lateral direction or a vertical direction, while the concrete which flows into the groove between the two angle bars which form the top chord bears against the bar stock which forms the zig-zag portion of the open web and prevents relative longitudinal movement.

DETAILED DESCRIPTION OF THE INVENTION

Figure 1:
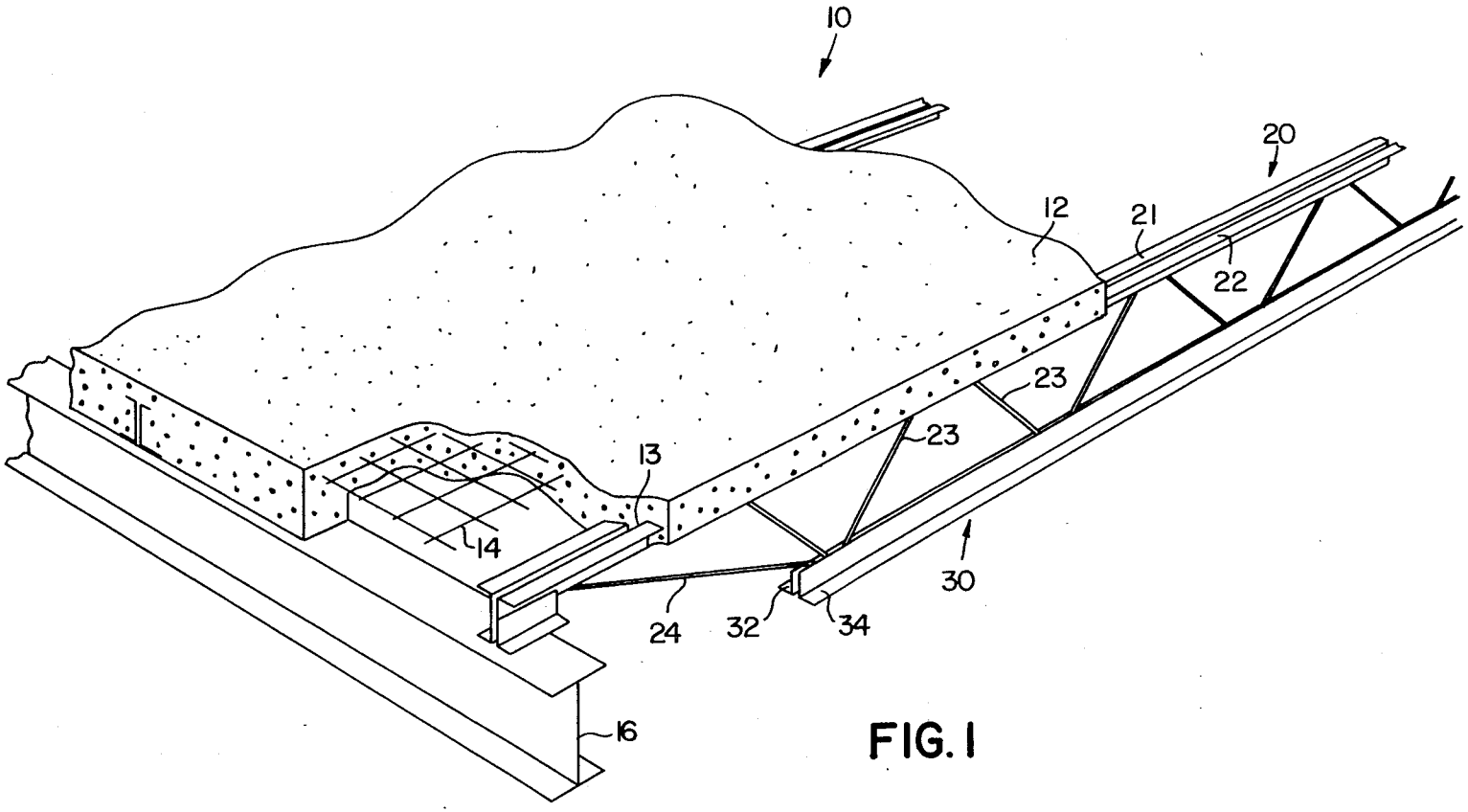
FIG. 1 is an isometric view of a composite concrete steel joist slab, a portion of which is broken out to expose parts encased within it.
Figure 2:
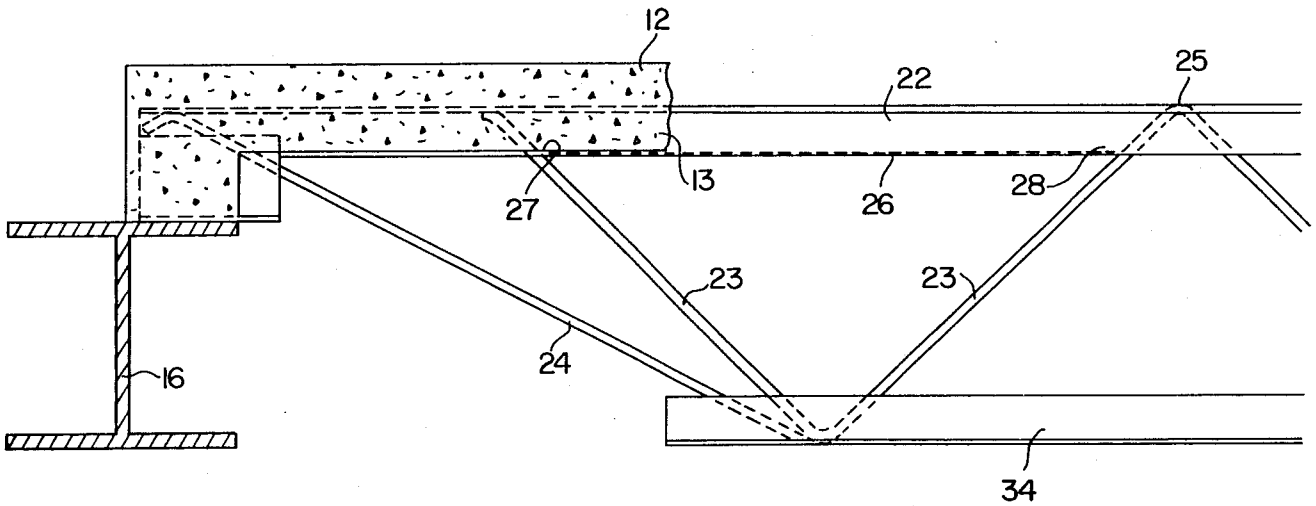
FIG. 2 is a view in longitudinal section of a composite concrete-steel joist slab similar to that of FIG. 1, except that a different portion of the slab is removed from this figure.

Referring to the drawings, FIGS. 1 and 2 show a composite structure 10 made in accordance with the present invention. Concrete slab 12, having reinforcing 14 is supported by open web joist members comprising upper chord 20, lower chord 30 and zig-zag web member 23. As shown, the ends of upper chord 20 and lower chord 30 are joined by bar 24. The open web joists are supported at the end of upper chord 20 by means such as I-beam 16 shown in FIG. 1.

Figure 3:
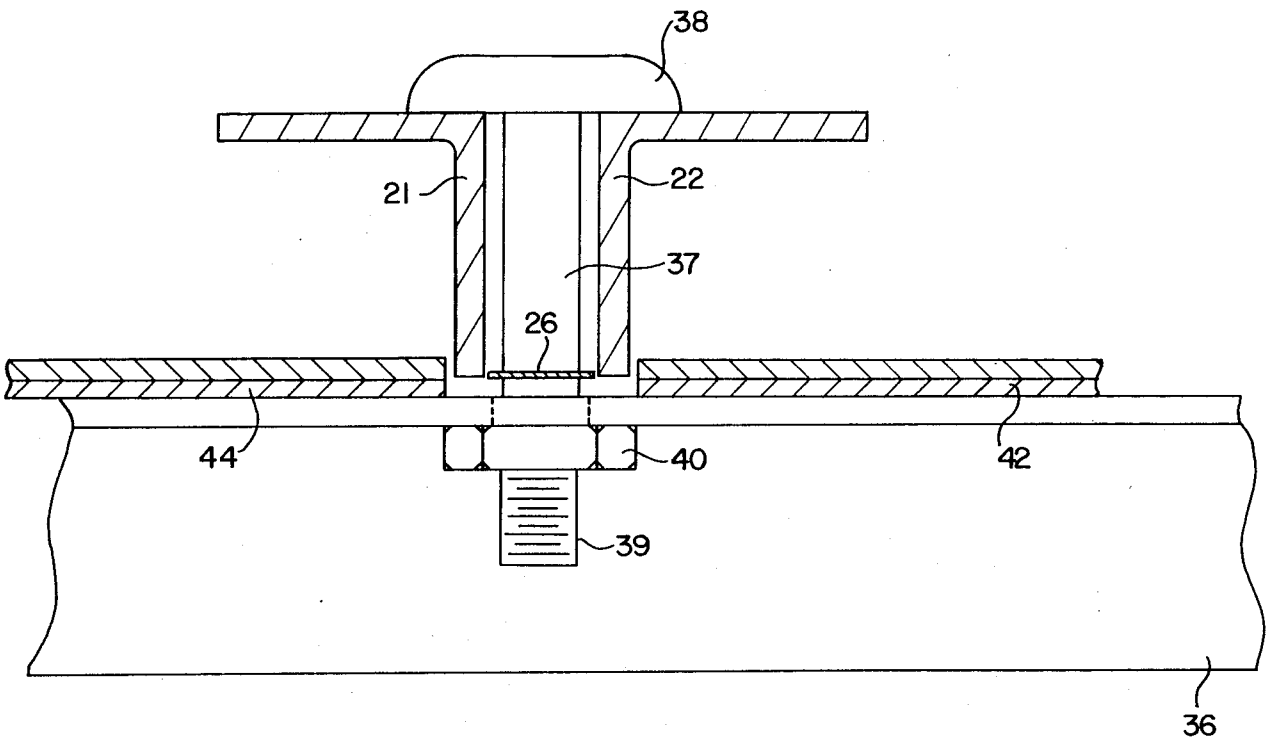
FIG. 3 is a view in transverse section of the upper chord of a joist showing elements which provide support for the forms for the concrete slab.

As shown in FIG. 3, the top chord of the joist comprising bars 21, 22 is shown supporting bolt 37 having bolt head 38 and threaded portion 39. Nut 40 supports angle bar 36 which in turn supports plywood panels 42 and 44. Concrete, which is poured on the panel, encases the top chord and flows into the gap between angle bar 21 and angle bar 22, being stopped in its downward motion by closure member 26. Closure member 26 extends longitudinally from a position 27 to position 28 on web member 23 as shown in FIG. 2.

Figure 4:
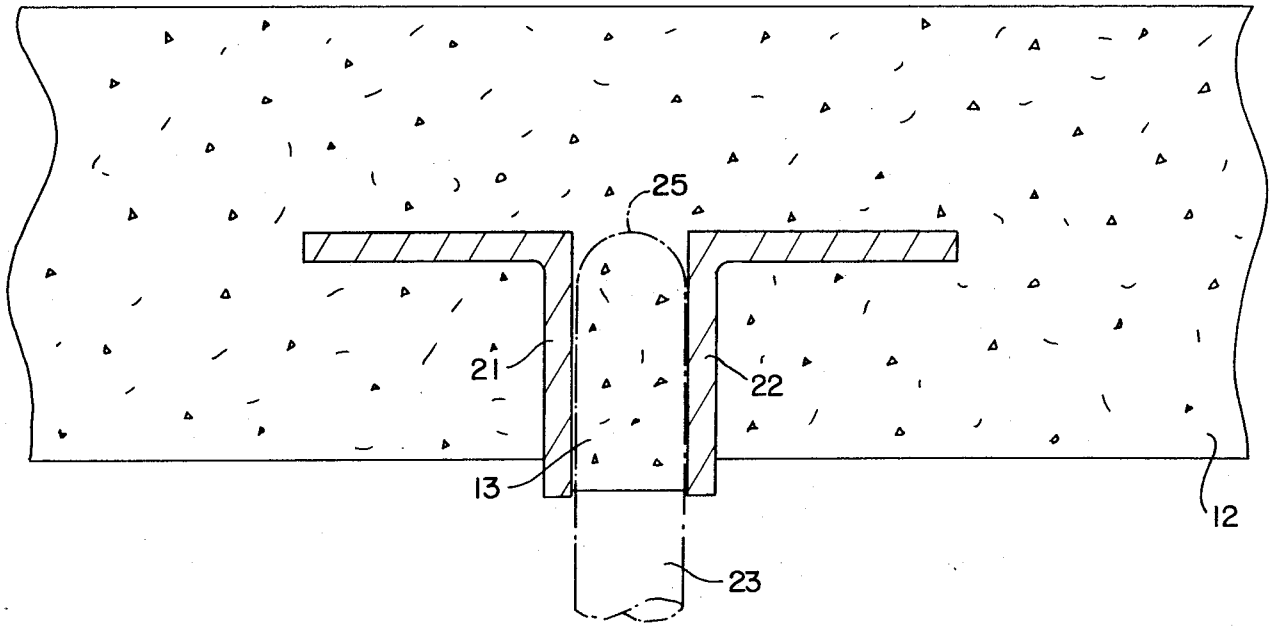
FIG. 4 is a view in transverse section of the upper chord showing a concrete slab encasing the upper chord.

As shown in FIG. 4, concrete fills the space between the angle bars 21 and 22 and forms a key-like element in this groove which prevents relative longitudinal movement of the concrete slab and the joist by bearing against web element 23. This key-like element 13 is also shown in FIG. 2.

The open web steel joist comprises a top chord, a bottom chord and an open web secured to the top and bottom chords. The upper chord is formed from two angle bars which must (1) have vertical legs depending downwardly from the horizontal legs of the bars (2) be substantially the same height, and (3) be separated from each other by the open web bar. This separation must be great enough, for example about 1 inch or greater, for concrete to flow downwardly between the bars.

The bar stock for the open web is preferably round bar stock which is secured to the upper and lower chords, as by welding, and preferably extends from the lower edge of the bottom chord to the upper edge of the top chord.

The bottom chord may have a variety of shapes and may, for example, comprise rectangular or round bar stock. Preferably the bottom chord comprises a pair of parallel spaced-apart angle bars similar to the angle bars of the top chord.

The bolt for holding a spanner bar must extend downwardly from the top of the top chord to a point sufficiently below the lower edge of the top chord to support the spanner bar. For example, a bolt having a shank length of about three to four inches may be used with a top chord formed from 2 inch by 2 inch angle bars.

As shown in FIG. 3, bolt 37 which supports angle bar 36 passes through an opening in closure member 26. Bolt 37 is preferably threaded a predetermined distance so that when nut 40 reaches the upper end of the threaded portion it is at the proper distance from the base of bolt head 38 for supporting angle bar 36 and plywood members 42 and 44 the desired distance below the top of the joist.

The spanner bars are preferably angle bars having holes drilled in an upper horizontal leg for insertion of the threaded portion of the bolt.

The closure member 26 is sheet-like, may be made from metal of plastic, and extends substantially across the space between the two vertical legs of the top chord at the lower portion thereof. The ends of the closure members are supported by the bar stock of the open web. It is necessary to provide openings in the closure members for the bolts which support the spanner bars, and the closure member may be further supported at or near their midpoint by these bolts.

The sizes of the various elements such as angle bars and bolts are determined by the live and dead forces to which the completed structures are subjected, and may readily be determined by workers in the art.

My co-pending application Ser. No. 796,140, filed Nov. 8, 1985, discloses the use of bolts to support forming members from the top of a joist and the disclosure therein relating to the use of bolts to support angle bars and concrete forms is incorporated herein.

What is claimed is:

1. An open web joist system for a composite joist-concrete slab comprising:

a top chord;

a bottom chord;

a zig-zag web member comprising metal bar stock secured to said top and bottom chords and triangulating the space therebetween, said top chord comprising first and second metal angle bars, each of said angle bars having a substantially planar horizontal leg having inner and outer edges and a substantially planar vertical leg depending downwardly from the inner edge of said horizontal leg, said vertical legs of said first and second metal angle bars being held in spaced-apart relationship by the bar stock of said open web member;

bolt means for supporting at least one spanner bar, said bolt means being suspended from said top chord and having a threaded shank portion extending into the triangular space formed by said open web member; and, a horizontally disposed closure member for blocking the flow of concrete downwardly between and past the vertical legs of said top chord, said closure member extending laterally between the vertical legs of the bars of the top chord at or near the lower edges thereof and extending longitudinally between two adjacent upwardly angled sections of the web member.

2. The system of claim 1 wherein the bolt means passes downwardly through an opening in the closure member and provides partial support for said closure member.

3. The system of claim 1 wherein the threading of the shank portion of the bolt means is limited to control the vertical position of the spanner bar.

4. A composite open web joist and concrete structure comprising a top chord, a bottom chord and a zig-zag web member comprising metal bar stock secured to said top and bottom chords and triangulating the space therebetween, said top chord comprising first and second metal angle bars, each of said angle bars having a substantially planar horizontal leg having inner and outer edges and a substantially planar vertical leg depending downwardly from the inner edge of said horizontal leg, said vertical legs of said first and second metal angle bars being held in spaced-apart relationship by the bar stock of said open web member; and concrete encasing said top chord and extending downwardly between the pair of spaced-apart parallel bars of said top chord sufficiently far to bear against at least a portion of the metal bar comprising the open web.

* * * * *